US008425730B2

(12) United States Patent
Biagiotti

(10) Patent No.: US 8,425,730 B2
(45) Date of Patent: Apr. 23, 2013

(54) METHOD AND DEVICE FOR THE PRODUCTION OF TISSUE PAPER

(75) Inventor: Guglielmo Biagiotti, Lucca (IT)

(73) Assignee: A. Celli Paper S.p.A., Lucca (IT)

( * ) Notice: Subject to any disclaimer, the term of this patent is extended or adjusted under 35 U.S.C. 154(b) by 0 days.

(21) Appl. No.: 13/402,420

(22) Filed: Feb. 22, 2012

(65) Prior Publication Data

US 2012/0152477 A1 Jun. 21, 2012

Related U.S. Application Data

(62) Division of application No. 11/568,476, filed as application No. PCT/IT2005/000234 on Apr. 21, 2005, now Pat. No. 8,142,613.

(30) Foreign Application Priority Data

Apr. 29, 2004 (IT) ..... FI2004A0102

(51) Int. Cl.
*B31F 1/07* (2006.01)

(52) U.S. Cl.
USPC ..... 162/362; 162/289

(58) Field of Classification Search ..... 162/358.1, 162/358.3, 358.5, 359.1, 361, 362, 289
See application file for complete search history.

(56) References Cited

U.S. PATENT DOCUMENTS

| | | | | |
|---|---|---|---|---|
| 2,402,966 | A * | 7/1946 | Linzell | 162/117 |
| 4,127,637 | A * | 11/1978 | Pietreniak et al. | 264/119 |
| 4,698,257 | A * | 10/1987 | Goll | 428/171 |
| 4,849,054 | A * | 7/1989 | Klowak | 162/109 |
| 4,911,788 | A * | 3/1990 | Pittman et al. | 162/145 |
| 5,071,511 | A * | 12/1991 | Pittman | 162/145 |
| 5,126,015 | A * | 6/1992 | Pounder | 162/206 |
| 5,223,092 | A * | 6/1993 | Grinnell et al. | 162/109 |
| 5,314,584 | A * | 5/1994 | Grinnell et al. | 162/109 |
| 5,851,353 | A * | 12/1998 | Fiscus et al. | 162/113 |
| 6,077,398 | A * | 6/2000 | Fiscus et al. | 162/361 |
| 6,277,226 | B1 * | 8/2001 | Schulz | 156/209 |
| 6,398,909 | B1 * | 6/2002 | Klerelid | 162/109 |
| 6,416,623 | B1 * | 7/2002 | Hollmark et al. | 162/109 |
| 6,488,816 | B1 | 12/2002 | Klerelid | |
| 6,503,370 | B2 * | 1/2003 | Hollmark et al. | 162/117 |
| 6,524,683 | B1 | 2/2003 | Roussel et al. | |
| 6,585,861 | B2 * | 7/2003 | Odhe et al. | 162/280 |

(Continued)

FOREIGN PATENT DOCUMENTS

| | | | |
|---|---|---|---|
| EP | 0 625 610 | A1 | 11/1994 |
| EP | 1731296 | A2 * | 12/2006 |

(Continued)

OTHER PUBLICATIONS

JPO Machine Translation of JP 08-260397 dated on Oct. 8, 1996.*

*Primary Examiner* — Jose A Fortuna
(74) *Attorney, Agent, or Firm* — McGlew and Tuttle, P.C.

(57) ABSTRACT

The invention relates to a method for the production of a web of tissue paper, including the steps of: depositing a layer of an aqueous suspension of papermaking fibers on at least one forming fabric; reducing the water content of the layer until the weight percentage of fiber in the layer is brought up to a first value; wet-embossing the layer in a nip between a pair of embossing rollers; and drying the layer to form a web of tissue paper.

26 Claims, 6 Drawing Sheets

U.S. PATENT DOCUMENTS

| | | | | |
|---|---|---|---|---|
| 6,596,127 | B2 * | 7/2003 | Hollmark et al. | 162/206 |
| 6,681,826 | B1 * | 1/2004 | Biagiotti | 156/470 |
| 6,755,928 | B1 * | 6/2004 | Biagiotti | 156/209 |
| 6,811,652 | B2 * | 11/2004 | Hollmark | 162/109 |
| 7,285,317 | B2 * | 10/2007 | Biagiotti et al. | 428/166 |
| 7,291,379 | B2 * | 11/2007 | Biagiotti | 428/166 |
| 7,758,724 | B2 * | 7/2010 | Akai et al. | 162/117 |
| 7,799,167 | B2 * | 9/2010 | Suzuki et al. | 162/117 |
| 7,976,683 | B2 * | 7/2011 | Scherb | 162/358.1 |
| 8,012,309 | B2 * | 9/2011 | Pare et al. | 162/117 |
| 8,142,613 | B2 * | 3/2012 | Biagiotti | 162/117 |
| 8,142,614 | B2 * | 3/2012 | Biagiotti | 162/117 |
| 2001/0013389 | A1 * | 8/2001 | Fingal et al. | 156/160 |
| 2002/0060007 | A1 * | 5/2002 | Hollmark et al. | 162/132 |
| 2002/0092633 | A1 * | 7/2002 | Odhe et al. | 162/111 |
| 2002/0116519 | A1 | 8/2002 | Wang | |
| 2003/0013318 | A1 | 1/2003 | Shiraishi | |
| 2003/0021953 | A1 | 1/2003 | Graff | |
| 2003/0026953 | A1 * | 2/2003 | Muller | 428/174 |
| 2003/0041989 | A1 * | 3/2003 | Oriarian et al. | 162/184 |
| 2003/0116292 | A1 * | 6/2003 | Hollmark | 162/132 |
| 2004/0038006 | A1 * | 2/2004 | Biagiotti | 428/172 |
| 2004/0055694 | A1 * | 3/2004 | Kershaw et al. | 156/209 |
| 2004/0247836 | A1 * | 12/2004 | Biagiotti | 428/172 |
| 2005/0147797 | A1 * | 7/2005 | Biagiotti et al. | 428/172 |
| 2005/0170145 | A1 * | 8/2005 | Biagiotti et al. | 428/156 |
| 2005/0257894 | A1 * | 11/2005 | Biagiotti | 156/553 |
| 2006/0037724 | A1 * | 2/2006 | Akai et al. | 162/117 |
| 2006/0042767 | A1 * | 3/2006 | Bhat et al. | 162/117 |
| 2006/0070714 | A1 * | 4/2006 | Perini | 162/362 |
| 2006/0278357 | A1 * | 12/2006 | Suzuki et al. | 162/117 |
| 2006/0280910 | A1 * | 12/2006 | Boatman et al. | 428/156 |
| 2008/0169072 | A1 * | 7/2008 | Pare et al. | 162/117 |
| 2008/0302493 | A1 * | 12/2008 | Boatman et al. | 162/109 |
| 2008/0308240 | A1 * | 12/2008 | Biagiotti | 162/117 |
| 2009/0126885 | A1 * | 5/2009 | Akai et al. | 162/117 |
| 2009/0199986 | A1 * | 8/2009 | Biagiotti | 162/117 |
| 2010/0038045 | A1 * | 2/2010 | Pare et al. | 162/117 |
| 2012/0152477 | A1 * | 6/2012 | Biagiotti | 162/286 |
| 2012/0205063 | A1 * | 8/2012 | Biagiotti | 162/117 |

FOREIGN PATENT DOCUMENTS

| | | | |
|---|---|---|---|
| EP | 1964968 | A1 * | 9/2008 |
| GB | 2 132 141 | A | 7/1984 |
| JP | 59-116500 | | 7/1984 |
| JP | 06-143466 | | 5/1994 |
| JP | 2002-522323 | | 7/2002 |
| JP | 2007015379 | A * | 1/2007 |
| WO | WO 9944814 | A1 * | 9/1999 |
| WO | 2005106116 | | 11/2005 |
| WO | WO 2005106116 | A1 * | 11/2005 |
| WO | WO 2007046124 | A1 * | 4/2007 |

* cited by examiner

METHOD AND DEVICE FOR THE PRODUCTION OF TISSUE PAPER

CROSS REFERENCE TO RELATED APPLICATIONS

This application is a divisional under 37 CFR 1.53(b) of prior application Ser. No. 11/568,476 filed Aug. 20, 2008, now U.S. Pat. No. 8,142,613 and claims the benefit (35 U.S.C. §120 and 365(c)) of International Application PCT/IT2005/000234 of Apr. 21, 2005, which designated inter alia the United States and which claims the priority of Italian Patent Application FI2004A000102 of Apr. 29, 2004. The entire contents of each application is hereby incorporated by reference in its entirety.

FIELD OF THE INVENTION

The invention relates in general to the production of so-called tissue paper, in some cases also referred to as creped paper, for the formation of rolls of toilet paper, paper wipes, and paper for similar uses. More in general, the invention relates to the production of a web-like fiber material, especially papermaking fibers or cellulose fibers, with a high capacity of absorption and a high degree of softness.

BACKGROUND OF THE INVENTION

A major sector of the paper industry is directed at the production of paper with good characteristics of liquid absorption and softness, for the production of products such as toilet paper, paper wipes, and the like. This type of paper product goes by the technical name of "tissue paper" and in certain cases crepe paper, as a result of the fact that a creping is imparted thereon in a step of formation, adopting various possible techniques. The most widespread of these envisages the adhesion of the web of cellulose fibers, which still contains a large amount of water, on an internally heated roller or drum of large diameter, referred to as "Yankee drier" or Yankee roller. Consequently, upon drying, the fiber web remains adherent to the roller and is detached therefrom using a blade which impresses a corrugation or crinkling on the paper during detachment thereof from the roller. This corrugation is responsible for an increase of the volume of the paper and its elasticity, which is prevalently in the machine direction, i.e., the direction parallel to the direction of feed of the web through the machine.

Examples of systems for wet production of tissue paper using the above system are described in the U.S. Pat. Nos. 4,356,059; 4,849,054; 5,690,788; 6,077,590; 6,348,131; 6,455,129; 5,048,589; 6,171,442; 5,932,068; 5,656,132; and 5,607,551, and in the European patent No. 0342646.

These systems, referred to technically as continuous machines, all envisage, in addition to other elements or particular apparatus, the presence of a headbox, which forms, on a formation fabric, a layer of a mixture of papermaking fibers and water, with a very low percentage of dry content, in the region of 0.5 wt % to 0.8 wt %. By means of successive steps through the machine, the percentage of water is progressively reduced until a web is formed with a dry fiber content in the region of 48-52 wt %, according to the type of system, at the moment in which the web is transferred from a fabric or felt to the rotating surface of the Yankee roller with the aid of a press, and here the humidity of the web is further reduced, until a percentage of fiber of 95-98 wt % is obtained. The web is at this point considered dry and ready for the next step; consequently, it is detached by the creping blade and then wound on a reel, as mentioned above.

In some systems, such as for example the one described in the U.S. Pat. No. 4,356,059, there are provided two Yankee rollers arranged in series, set between which is a hot-air drying system referred to as "Through Air Drier" (TAD), in which the web of cellulose fibers is entrained around a rotating roller with a pervious cylindrical wall, through which a flow of hot air is generated. This drying system yields a web of large thickness and volume.

The use of the creping blade involves numerous drawbacks, in the first place, tearing of the web. The mechanical action of the blade on the web of fiber is, in fact, rather violent and constitutes the principal cause of tearing of the web during its detachment from the drying roller. Tearing of the web in systems for wet production of paper represents a serious problem in so far as, since it is not possible to stop the system, which is built for working continuously on three shifts a day on account of the thermal inertia especially of the Yankee roller, there will be interruptions in the web wound in reels which entail serious technical consequences and, above all, consequences of an economic nature in the form of a major loss in efficiency of the transformation systems that use these reels.

Other drawbacks of the technique of creping using a blade which cooperates with the Yankee roller are represented by: the fast wear of the creping blade, which must be replaced at least once per shift; the high degree of compactness of the fibers in the web that is consolidated and dried on the smooth surface of the Yankee roller; the formation of dense hydrogen bonds between the fibers, oriented mainly according to horizontal planes; and the difference in thickness of the web obtained with a new blade and with a worn blade, which evidently does not guarantee constancy of characteristics of the web (see U.S. Pat. No. 6,187,137).

According to a different technique, a corrugation in the web is obtained by passing the web still having a high content of humidity from one formation fabric, which moves at a first speed of advance, to a second formation fabric, which moves at a second speed of advance, lower than the first speed of advance. The deceleration undergone by the web causes creping and corrugation thereof. A suction system set appropriately with respect to the formation fabrics withholds the paper material being formed to facilitate the generation of crinkles in the web. Examples of systems based upon this technology are described in the U.S. Pat. Nos. 4,072,557 and 4,440,597.

The U.S. Pat. No. 4,551,199 describes a method and a system in which the web is transferred from a faster fabric to a slower fabric and in which the slower fabric has a particular surface mesh to bring about corrugation of the web.

Similar systems and methods of this type are described in the U.S. Pat. Nos. 5,607,551; 5,656,132; 5,667,636; 5,672,248; 5,746,887; 5,772,845; 5,888,347; and 6,171,442.

In the systems known from these prior-art documents, downstream of the fabric on which the corrugation, takes place, the web is dried with a TAD system, thus preventing also the other drawbacks linked to the use of the Yankee roller.

On the other hand, the TAD systems are also affected by drawbacks which render their use as an alternative to the drying system with the Yankee drier not always practicable or desirable. For example, the costs in terms of energy, consumption are higher, on account of the need to generate enormous rates of flow of hot air that traverses the web to dry it. In addition the web thus formed is thicker than the one obtained with the creping blade and can present through holes, due to the use of the flow of air that traverses the web to dry it.

To increase the thickness of the paper material produced by continuous machines, there have been suggested various methods and techniques combined with one or the other of the different creping systems. In the U.S. Pat. No. 6,077,590, for example, downstream of the Yankee roller with corresponding creping blade there is provided a humidifier, in which the paper that has previously been dried and creped is once again moistened. At output from the humidifier, there is provided a wet-embossing assembly, comprising a pair of embossing rollers made of steel, one of which has protuberances and the other has mutually corresponding cavities. The purpose of this system is to obtain a product having a large thickness and a high degree of resistance. The use of a Yankee roller and, downstream thereof, of a moistening section and a wet-embossing section involves numerous drawbacks. The main drawbacks are the following: the problems deriving from the risks of tearing of the web on account of the use of a creping blade are not solved; the production line is complex, costly and cumbersome; and the humidification of the web involves high consumption levels in terms of energy and water.

Described in the U.S. Pat. No. 4,849,054 is a system in which the web of cellulose fibers with high water content is transferred along its own path to a formation fabric that has a surface texture given by the mesh of the fabric structure that forms it, which imparts an embossing on the web. This is due to the fact that the web, with high water content and hence limited resistance, comes to rest on the depressions formed between the threads defining the structure of the fabric. Embossing is facilitated by the use of a suction system set on the side of the fabric opposite to the side on which the web comes to rest. Also in this case, the web embossed using this technique is subsequently dried on a Yankee roller and creped with a creping blade that detaches it from the drying roller. The system is thus characterized by the drawbacks described above, which are linked to the use of creping blades.

The use of a fabric with a surface structure designed to bestow a wet-embossing effect on the web being formed is described also in the U.S. Pat. No. 6,187,137 and in WO-A-9923300. Embossing is obtained by the combination of the particular fabric with the aforesaid surface structure by means of a pressurized-air system, which transfers the web from an upstream fabric set to the surface-structured fabric. To avoid the use of a creping blade in combination with a Yankee roller and at the same time in order not to use a TAD drying system, with the corresponding costs associated thereto and mentioned above, it has been suggested in the above documents of the prior art to carry out an operation subsequent to embossing on fabric, consisting in making the web, whilst still damp, to adhere to a Yankee roller, drying it, and subsequently detaching it therefrom without the use of a creping blade. In this way, drying involves lower costs as compared to drying using TAD systems, and the creping blade, which presents drawbacks deriving therefrom, is not used.

However, this technique involves application on the Yankee roller of a mixture of adhesive agents and of detaching agents in order to enable, on the one hand, proper adhesion of the web to the roller and, on the other, ease of detachment without any risk of tearing and without the use of mechanical members such as the creping blade. The use of this mixture of products, on the one hand, involves drawbacks in terms of consumption and of operating costs and, on the other, constitutes a critical aspect of the process, in so far as the products applied must in effect perform two mutually contrasting actions, with the consequent need to select carefully the products of the mixture and to balance them in a precise and accurate way.

SUMMARY OF THE INVENTION

The general object of the present invention is to provide a method and a system for the production of tissue paper, which will overcome entirely or in part one or more of the aforesaid drawbacks typical of traditional systems and methods.

According to a particular embodiment, an object of the invention is to provide a method and a system with which a tissue paper can be obtained with characteristics similar to or even better than those of the paper creped using a creping blade, but without the use of the creping blade and hence avoiding the drawbacks linked to the latter, in the first place the risk of tearing of the web during its detachment from the drying cylinder.

According to a particular aspect of a specific embodiment of the invention, a further object is to increase the productivity of the continuous machine.

Basically, according to a first aspect, the invention relates to a method for the production, of a web, of tissue paper, comprising the steps of:

- depositing a layer of an aqueous suspension of papermaking fibers on a formation fabric;
- reducing the water content in said layer until the weight percentage of fiber in said layer is brought up to a first value;
- wet-embossing said layer in a nip between a pair of embossing rollers; and
- completing the drying of said layer to form a web of tissue paper.

Essentially, the invention is based upon the concept of corrugating the layer of papermaking fibers to bestow on the web the desired elasticity, in particular via an embossing process based upon a particular pattern that has the capacity of creating a dense series of elastic profiles when the web being formed is still moist and of completing the drying of said web in a subsequent step so as to create in the material a "memory", i.e, a tendency to return into its initial configuration if subjected to a tensile stress and then released, instead of creping the material that has reached complete drying using a blade or doctor knife that works in combination with a drying cylinder, i.e., a so-called steel Yankee dryer, to detach the web when completely dry and create thereon the microcrinkles that bestow elasticity on the web.

According to some of the known methods and systems, there is in effect carried out a wet-embossing of the layer of papermaking fibers. However, this embossing is not carried, out using embossing cylinders or rollers, but rather by resting the moist layer of papermaking fibers on a fabric presenting a coarse surface structure, and only has the purpose of bestowing a thickness on the web. In the known systems that use this technique, the layer of papermaking fibers is in any case subjected to an operation of drying and of creping using a detaching blade co-operating with a steel Yankee dryer. According to the invention, instead, the corrugation on the web of fibers is imparted substantially only as a result of an embossing, between embossing cylinders or rollers and has two purposes: the first and most important purpose is to bestow elasticity on the paper without the use of a creping blade, and the second purpose is to impart a thickness on the web itself.

Drying can be achieved using a drying cylinder set downstream of the embossing rollers, or else using a set of idle guiding rollers, around which the layer of papermaking fibers is entrained. Alternatively, drying can be obtained entirely or partially via the use of embossing rollers, at least one of which is heated. All these systems can also be used in combination with a hot-air hood, which contributes to reducing the drying time, working also on the second face of the web. The above or other equivalent drying systems can be combined with one another.

The reduction in the water content, i.e., the partial drying of the layer of papermaking fibers prior to embossing thereon, is carried out until a dry content is reached, i.e., a weight percentage of fibers with respect to the total weight of the layer, which bestows on the layer itself a consistency sufficient to resist the mechanical operation of embossing.

According to an advantageous embodiment of the invention, at least one first of said embossing rollers is provided with protuberances and at least one second of said embossing rollers is provided with cavities, in which said protuberances of the first embossing roller penetrate. In practice, the two rollers have corresponding incisions, which define complementary protuberances and cavities, so that the two rollers co-operate with one another with the protuberances of one which mesh with the protuberances of the other, i.e., they penetrate into the cavities of the other. Basically, the two rollers can be specular.

In contrast with what is most frequently envisaged in the embossing process performed during converting, on the dry paper, which occurs between a rigid cylinder provided with protuberances and a pressure cylinder that is smooth and is coated with compliant material (normally rubber), in the wet-embossing process according to the invention the web or layer of papermaking fibers still moistened is passed between the protuberances of the first roller that mesh with the cavities of the second roller and vice versa, bestowing on the web or layer a deformation that generates thereon the desired elasticity and increases the total final thickness thereof.

Preferably, embossing rollers are kept at a distance such that the protuberances of the first embossing roller and the cavities of the second embossing roller are not in mutual contact, but rather preferably kept at a distance apart equal to or slightly greater than the thickness of the layer of papermaking fibers.

Preferably, the protuberances of the first embossing roller have a base with a first dimension in the direction of advance of the layer (indicated also as machine direction) smaller than a second dimension in the transverse direction. For example, the protuberances can have a pyramidal shape with a quadrangular base, in particular, preferably, rhomboidal with more or less rounded edges, with a minor diagonal oriented according to the direction of advance of the layer and a major diagonal oriented according to a transverse direction.

According to a different aspect, the invention relates to a system for the production of tissue paper, comprising: at least one headbox; at least one formation fabric, on which said headbox distributes a layer of an aqueous suspension or aqueous mixture of papermaking fibers; a system for removal of water from said layer; a first drying system; an embossing assembly comprising a first embossing roller and a second embossing roller, between which there passes the layer prior to the total removal of water; a second system for drying the layer of papermaking fibers; and, finally, a winding system for the production of reels of paper.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
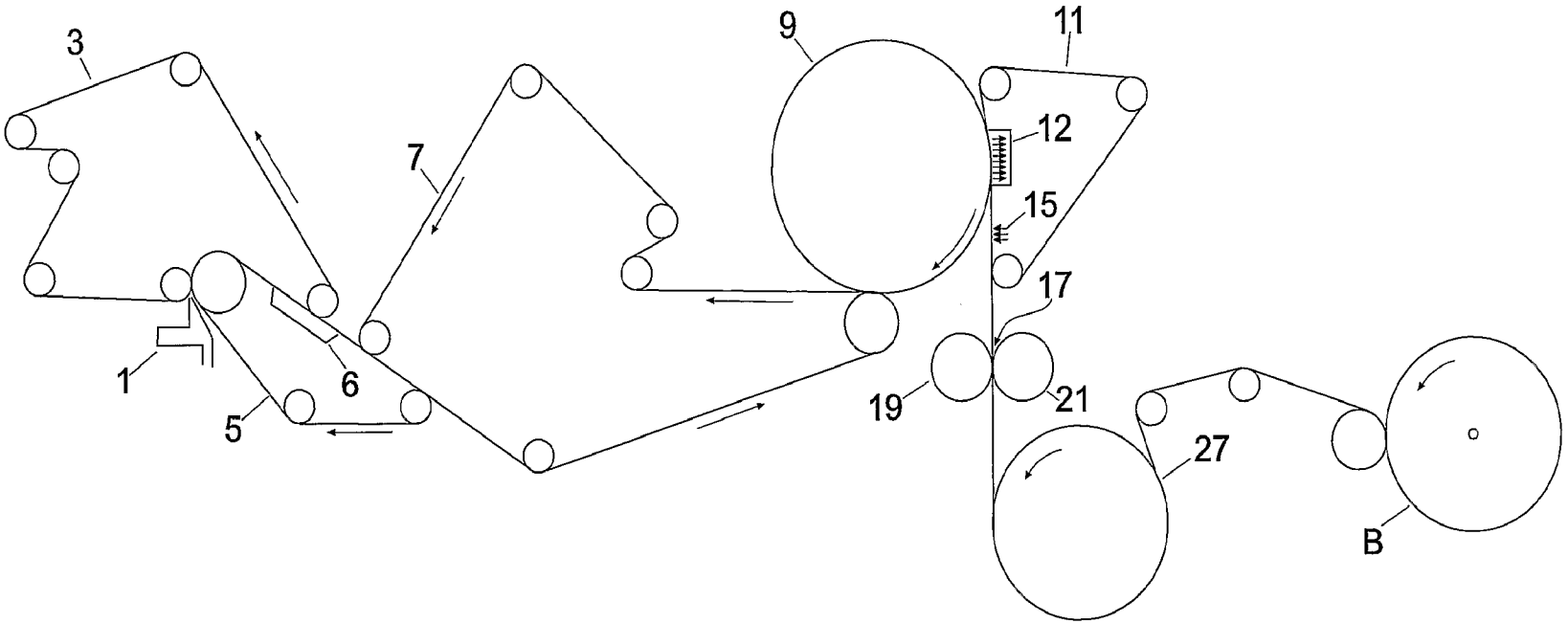
FIG. 1 is a schematic view of a system according to the invention.

Referring to the drawings in particular, FIG. 1 is a schematic illustration of the arrangement of a possible system for production of tissue paper according to the invention. The reference number 1 designates as a whole a headbox that forms a layer of a suspension or a mixture of papermaking fibers and water (with possible further additives known to persons skilled in the art that is fed between two formation fabrics designated by 3 and 5. The direction of advance of the two formation fabrics 3 and 5 is indicated by the arrows in FIG. 1. In the example illustrated, associated to the formation fabric 5 is a suction chamber 6 that carries out drainage of part of the water contained in the mixture or suspension forming the layer S.

The layer S, which is formed between the fabrics 3 and 5 and from which part of the water has been drained via the suction chamber 6, is transferred to a conveying felt 7, which releases this layer to a first heated drying cylinder or roller 9. This roller 9 can be a steel Yankee dryer, a Honeycomb roller, or else a roller of a drying system of the TAD type, i.e., a roller perforated along its own periphery, which enables the passage of a flow of heated air from the inside to the outside, said flow of air traversing the layer of papermaking fibers entrained around the roller to remove part of the water contained in said layer.

Whatever the drying system 9 employed, it eliminates from the layer S an amount of water sufficient to reach a degree of dry content which bestows on the web itself a mechanical resistance sufficient for being subjected to an action of embossing without undergoing any damage or tearing. Typically, the layer S is dried to reach a degree of dry content comprised in the range of 60 wt % to 90 wt %, i.e., up to a condition in which the dry content of papermaking fibers in the layer reaches 60 wt % to 90 wt % with respect to the overall weight of the layer, the remainder being water.

The partially dried layer is detached from the drying cylinder 9 or other drying system for example via a fabric 11, associated to which is a suction chamber 12 set on the opposite side of the fabric with respect to the face thereof that comes into contact with the layer S of papermaking fibers. Downstream of the suction chamber 12, with respect to the direction of advance of the layer S, there is set a pressure chamber 15, i.e., a chamber from which a flow of air at a slight pressure is emitted. The pressure chamber 15 is set, with respect to the fabric 11, on the same side as the chamber 12. The chamber 15 has the purpose of generating a current of air which facilitates detachment of the layer S from the fabric 11.

Set downstream of the fabric 11 is an embossing assembly 17, comprising a first embossing roller 19 and a second embossing roller 21, which define between them an embossing nip, through which there is fed the layer S of papermaking fibers which has been previously partially dried on the drying roller 9.

Figure 2:
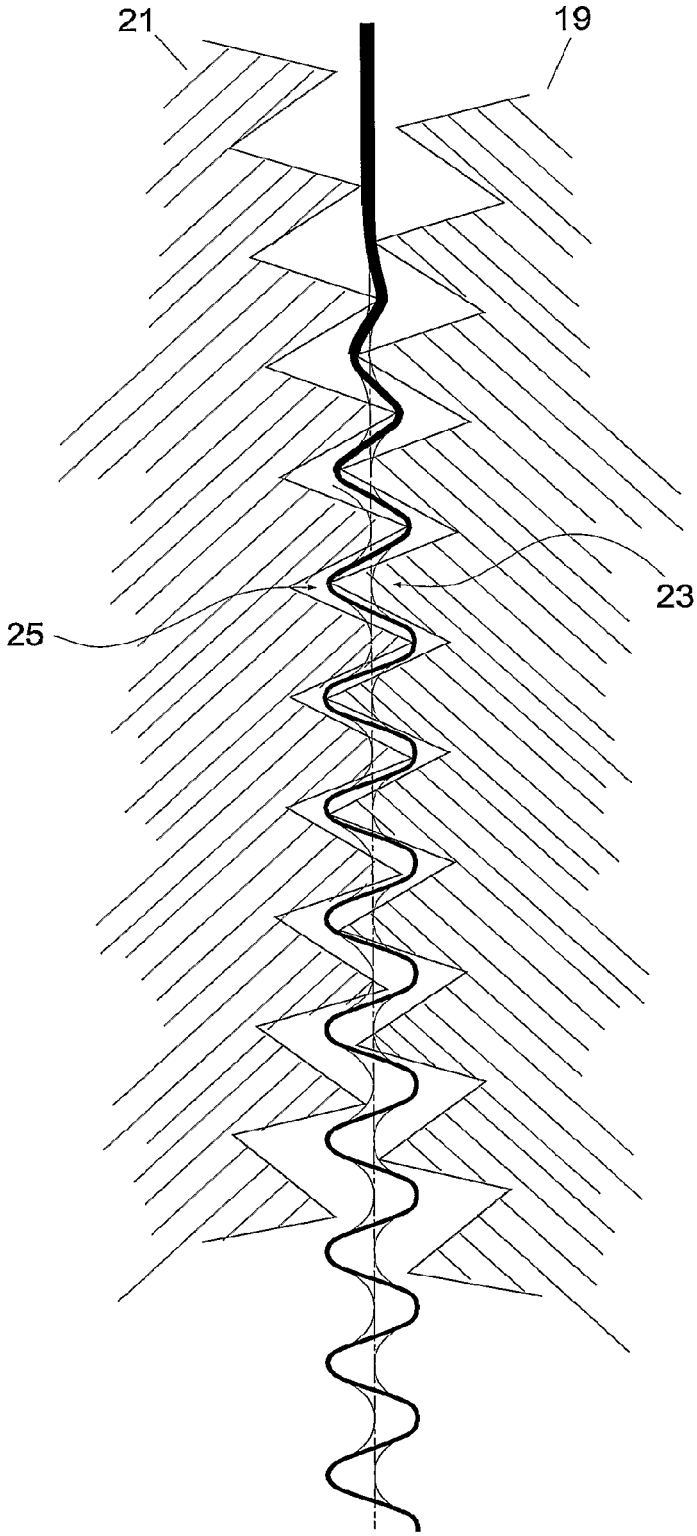
FIG. 2 is an enlarged view of the nip between the two embossing rollers in a section perpendicular to the axis of the rollers themselves.
Figure 3:
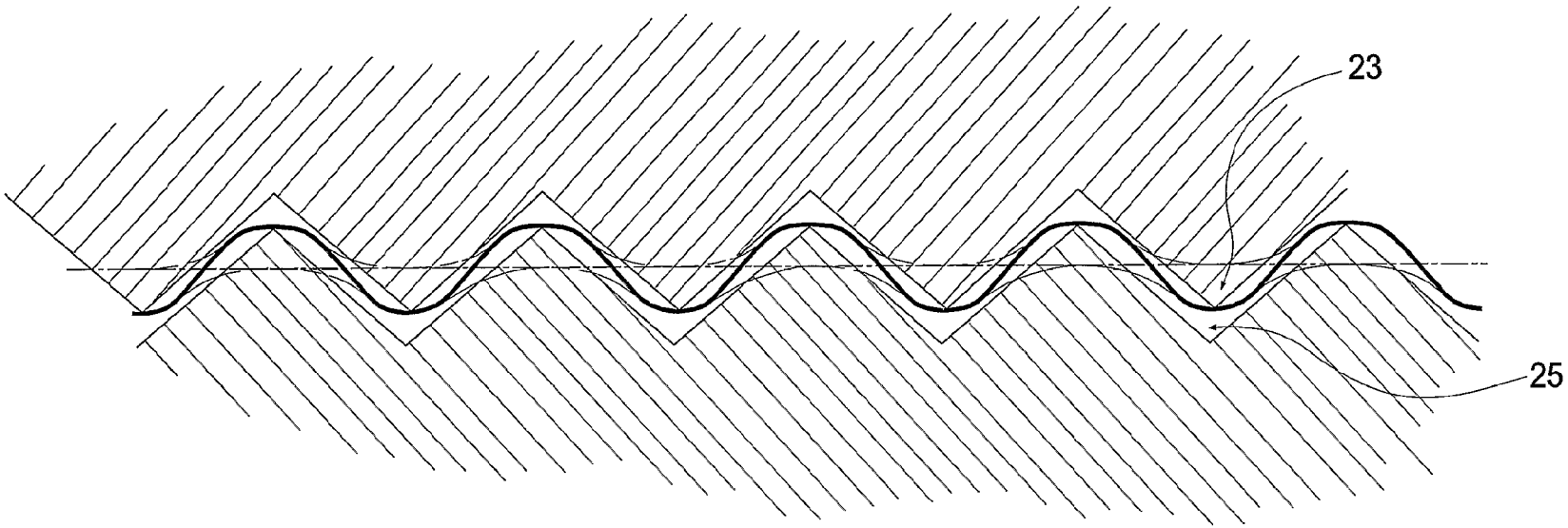
FIG. 3 is a cross-sectional view of the nip between the two embossing rollers according to a plane containing the axes of the rollers.

As illustrated in particular in FIGS. 2 and 3, the two embossing rollers 19, 21 are provided with protuberances 23 and cavities 25 corresponding to one another, i.e., which mesh with one another. Said protuberances and cavities can be obtained by etching using a machining system, by plastic deformation, chemical etching, or by any other known system. The surfaces of the two rollers can be complementary, with the protuberances of one corresponding to the cavities or incisions of the other. In practice, it may be envisaged that the two cylinders will be both obtained using a process of incision that generates protuberances having the shape of a truncated pyramid or a pyramid. The cavities are represented by the spaces present within each set of four protuberances.

The distance between the centers of the embossing rollers 19, 21 is such that the two rollers do not touch one another even in the position corresponding to the plane containing the respective axes. Between the surface of the protuberances 23 and the surface of the corresponding cavities 25 there always remains also in the nip between the rollers, a space substantially equal to the thickness of the layer S of papermaking fibers, or else slightly greater than said thickness. In this way, the layer S is not squeezed and is not stressed mechanically by compression as occurs, instead, in dry embossing of the paper when a cylinder provided with protuberances is pressed against a roller coated with smooth rubber, the surface of which is deformed by the embossing pressure.

Figure 4:
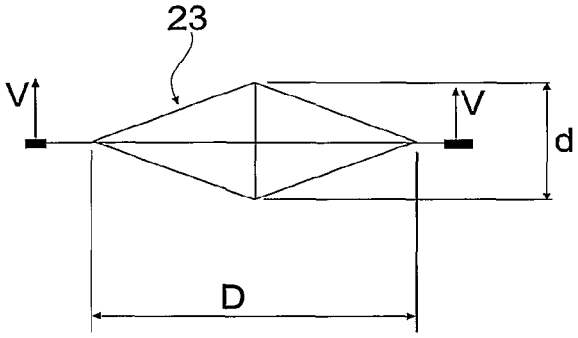
FIG. 4 is a plan view of a protuberance of one of the embossing rollers.
Figure 5:
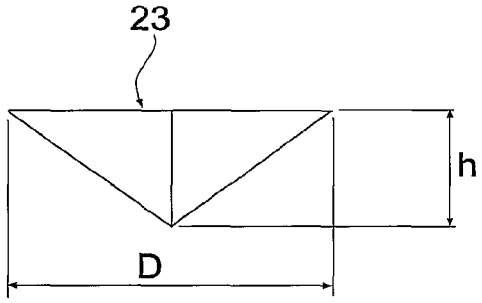
FIG. 5 is a side view of a protuberance of an embossing roller.

As illustrated in particular in FIGS. 4 and 5, the protuberances 23 have a pyramidal shape with rhomboidal base, the minor diagonal of which is designated by d and the major diagonal by D. The cavities 25 are obtained as incisions of a corresponding shape and enable penetration therein of the pyramidal protuberances. As may be noted in the drawing, the protuberances and the corresponding cavities 23, 25 are oriented in such a way that the major diagonal of the respective bases is parallel to the axes of rotation of rollers 19, 21, i.e., oriented in a transverse direction with respect to the direction of advance of the layer S. The minor diagonal is oriented in the direction of advance of the layer S, referred to also as machine direction.

Set downstream of the embossing assembly 17 is a second drying roller 27, which may be a steel Yankee dryer, a Honeycomb roller, a TAD roller or any other equivalent system. For example, there can also be used drying systems comprising a plurality of rollers along which the wet-embossed layer S is guided. At output from of the drying roller 27 (or equivalent drying system) the layer S by now dried forming a web of tissue paper ready for the subsequent converting is wound to form a reel B.

The drying process downstream of the embossing process stabilizes the deformation obtained in the embossing step so that the paper maintains stably in a resting condition the corrugation imparted on the paper by the protuberances 23 in combination with the cavities 25 of the embossing rollers 21 and 19. This bestows elasticity on the paper, which can be deformed like a spring also thanks to the particular form of embossing and, if subjected to tensile force, can undergo a lengthening that is useful in the subsequent transformation step, but will return to its original condition when the tensile stress ceases, at least for values of tensile stress that do not exceed the tearing load of the paper.

It is to be understood that part of the drying operation (or even the entire drying operation) can be obtained by heating one or the other or both of the embossing rollers 19 and 21 instead of by drying means downstream of the embossing assembly.

Figure 6:
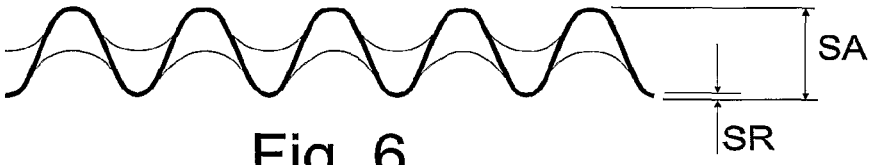
FIG. 6 is an enlarged schematic cross-sectional view of the paper obtained with the process according to the invention in a resting configuration.
Figure 7:
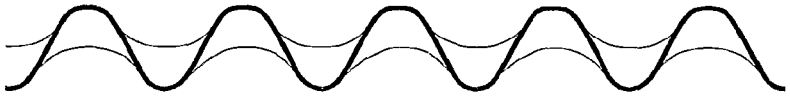
FIG. 7 is an enlarged schematic cross-sectional view of the paper obtained with the process according to the invention in a condition of elastic deformation that is assumed when the paper is subjected to a tensile force.

FIGS. 6 and 7 are schematic illustrations of a longitudinal section of the paper obtained with the system and method described herein. Said paper has an alternation of protuberances and cavities corresponding to the distribution of the protuberances and cavities 23, 25 of embossing rollers 19, 21. In this way, the apparent thickness SA of the paper is much greater than the actual thickness SR of the fiber layer that forms it.

The advantages of the above process or method of wet production of paper with respect to traditional methods are multiple. In the first place, it may be noted that the finished product, although it is a tissue paper that has all the characteristics of softness, absorption capability, and elasticity of a paper obtained by means of a system that envisages creping using a blade, is not obtained with the use of a creping blade. The consequence is elimination of all the drawbacks outlined previously which characterize the use of the creping blade.

Furthermore, the Yankee cylinder 9 can present dimensions substantially smaller than the Yankee cylinders usually employed, in so far as it does not have to bring the layer of papermaking fibers to a value of final drying in the range of values of 95-98 wt % as is normally the case in the paper industry.

Since it is not necessary to use a creping blade co-operating with a Yankee cylinder for creping the paper, it is possible to add to the mixture of papermaking fibers a larger amount of softening agents, which have as side effect that of facilitating detachment from the Yankee cylinder without using a blade, enabling the production of softer papers with lower risks of tearing.

Since embossing is carried out between two rollers that are not pressed against one another, but rather are kept with the respective surfaces at a certain distance apart, the fibers are not compacted, and the paper maintains its characteristics of softness and absorbency.

In contrast with what occurs in the production of paper with the use of a Yankee roller and a creping blade, by using embossing rollers having surfaces characterized by protuberances and cavities, there is obtained a web without any "smooth" side, as occurs instead with the use of the Yankee cylinder. Hence, the paper does not require any particular attention in the step of transformation.

Using fine incision on the embossing rollers, i.e., cavities and protuberances 25, 23 of small dimensions, adopting the method according to the invention there can be obtained surface characteristics of the paper which may be likened to those of the impressions left by the fabrics of TAD paper, but obtaining an apparent thickness much larger than what may be achieved with the known systems.

Finally, the process according to the invention enables a substantial increase in the productivity of continuous machines for the production of paper.

In fact, in traditional systems, the amount of mixture or aqueous suspension of papermaking fibers that the headbox can deposit on the formation fabric must take into account the fact that, in the creping step, the thickness of the paper is increased. Once the actual final thickness that it is desired to obtain after creping using the traditional method has been fixed, the thickness (and hence the amount of mixture) that the headbox can deposit on the formation fabric is in any case smaller than the one that the paper at output from the machine must possess. This involves a reduction in the amount of material per unit time that the headbox can supply and hence, in practice, a limitation of the overall productivity of the continuous machine. In other words, if the headbox can generate paper at a certain rate, for example 1000 m/min, this rate will be reduced to 800-900 m/min at the end of the process as a result of creping, which, by increasing the apparent thickness, reduces the dimension of the web corresponding to the direction of advance.

Instead, using the method according to the invention, in the embossing section, the paper (i.e., the partially dried layer of fiber) undergoes an increase in the actual thickness, accompanied by a lengthening in the direction of advance of the web. Consequently (and irrespective of further positive effects of embossing, which will be described hereinafter), the thickness of the layer S and hence the amount of material supplied by the headbox given the same final characteristics of the web on the reel must be greater than the final desired thickness, since the effect of thickening caused by traditional creping is replaced by the thickening, which is even greater, and the lengthening generated by embossing. This means, basically, that the amount of aqueous suspension or mixture of papermaking fibers that can be supplied per unit time by the headbox is higher than what may be achieved in traditional continuous machines.

In other words, if the headbox can generate paper at a rate of 1000 m/min, this rate will rise to 1100-1200 m/min at the end of the process as a result of the lengthening impressed by embossing, which increases the dimension of the web corresponding to the direction of advance.

For example, supposing that an actual thickness SR of 0.08 mm of the paper at output shall be achieved (a value comparable to the most frequent data), using embossing rollers 19, 21 provided with protuberances and cavities of a pyramidal shape as illustrated in FIGS. 4 and 5 with dimensions D=0.8 mm; d=0.291 mm; h=0.174 mm and assuming that a deformation of the layer S of 80% of the height h of the protuberances is achieved, i.e., of the depth of etching, the following apparent thickness is achieved:

$$SA=s+0.80*h=0.08+0.8*0.174=0.219 \text{ mm.}$$

Furthermore, considering that the volume per unit surface of material of the embossed layer must be equal to the volume supplied by the headbox given the same unit surface (conservation of the volume) to obtain the actual final thickness of 0.08 mm, if it is taken into account that the initially plane layer is deformed following the lateral surface of the protuberances and cavities of the rollers 19, 21, given the dimensions indicated above of the incisions of the rollers, it is calculated that the thickness of the layer at output from the headbox must be 0.127 mm.

It is a much greater thickness as compared to the one that could be obtained with a traditional continuous machine, given the same final actual thickness SR (0.08 mm). Assuming, with a conservative hypothesis, that to obtain an actual thickness SR at output from a machine with creping using a blade on a Yankee drier the thickness of the layer formed by the headbox will have to be 0.08 mm (and therefore neglecting the fact that in actual fact said thickness must be even smaller on account of the increase in actual thickness imposed by creping), the increase in productivity using the process according to the invention as compared to a system with creping blade is equal to a factor 0.127/0.08=1.587, which means an increase of approximately 60%.

The productivity of the continuous machine, in fact, is given by the volume of mixture that can be supplied in time given the same rate.

A further factor which in actual fact increases the productivity of the machine is represented by the fact that embossing increases the length of the layer or web of paper, so that the speed of the layer S at output from the embossing assembly 17 and consequently the speed of winding on the reel B is greater than the speed at input to the embosser 17 and, hence, the rate at which the layer S is formed by the headbox. Instead, in traditional continuous machines, the winding rate is lower than the production rate on account of the reduction in length of the layer of paper caused by the creping blade.

Figure 8:
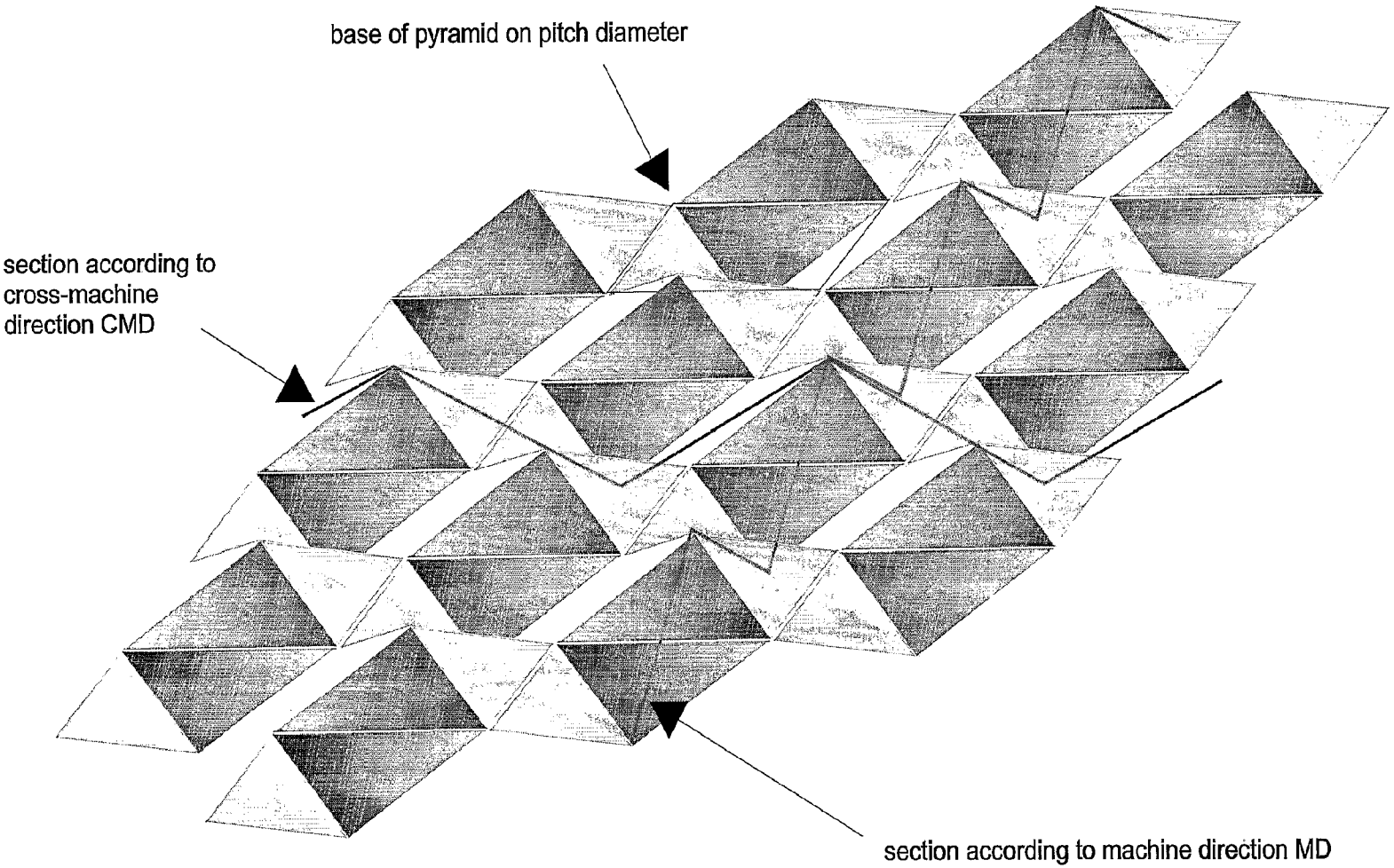
FIG. 8 is a schematic perspective view of a portion of paper obtained according to the invention.

FIG. 8 is a schematic perspective view of the embossed paper web. Indicated in the figure are the bases of the pyramidal protuberances with square base on the primitive diameter of the roller and the lines of section according to the machine direction (MD), i.e., the direction of advance, and according to the cross machine direction (CMD), which is orthogonal to the machine direction. It will be understood that the representation of FIG. 8 is purely schematic and that, in actual fact, the protuberances of the embossed web will be less faceted.

Figure 9:
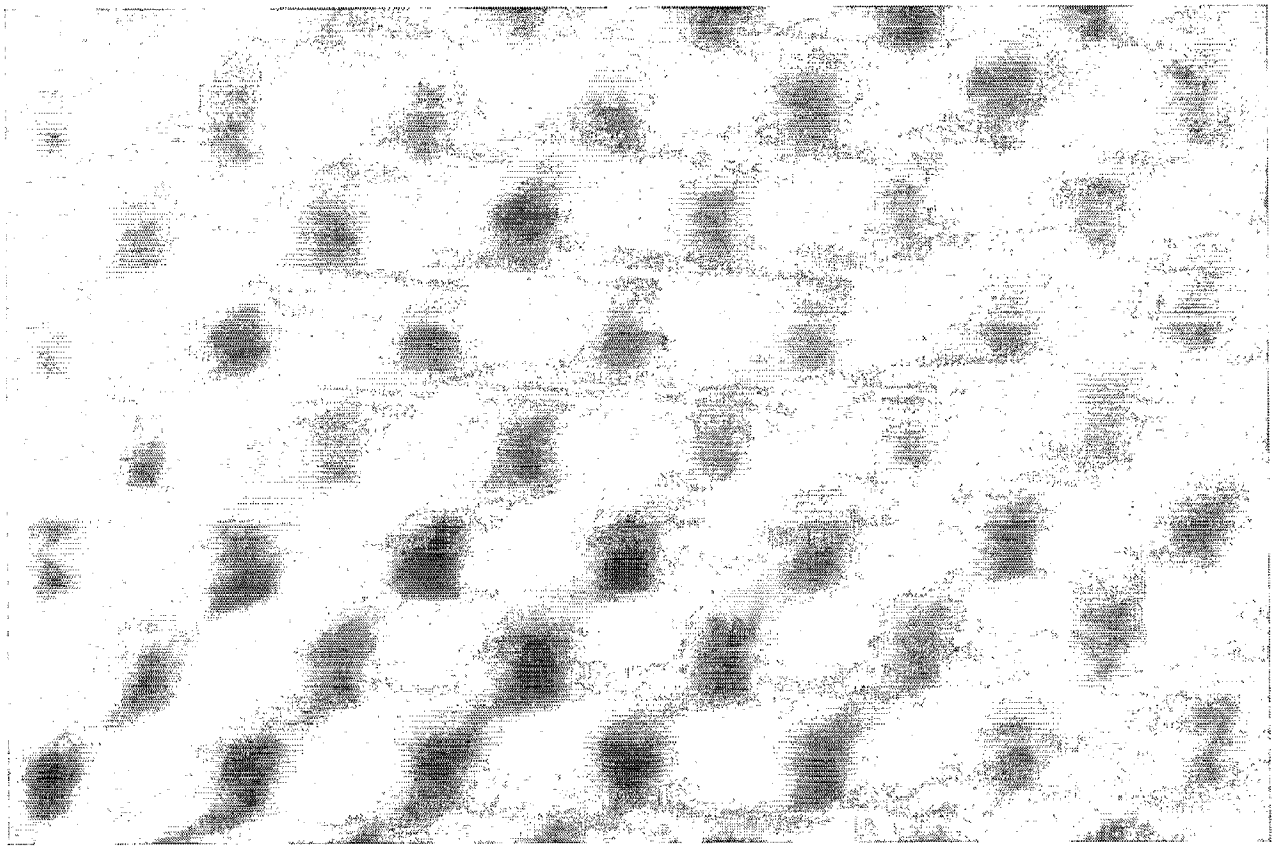
FIG. 9 is an enlarged photographic view of a portion of paper obtained with a process according to the invention but with protuberances of the embossing rollers having a profile shaped like a truncated pyramid or a pyramid with a base that is square, instead of rhomboidal.

FIG. 9 illustrates, by way of example, a macro-photograph of a portion of web treated according to the invention, with an embossing profile constituted by protuberances having the shape of a truncated pyramid with a base that is square instead of having an elongated rhomboidal base as illustrated in the foregoing figures.

In an alternative embodiment the protrusions or protuberances and cavities of the two embossing rollers have a continuous linear shape extending parallel or substantially parallel to the roller axes. This would provide an embossing in the form of a fluting or corrugation more similar to the actual creping generated by a doctor blade co-acting with a Yankee drier. Other alternative shapes and configurations of the cavities and protrusions of the two embossing rollers are possible. The dimensions of the linear embossing protrusions can be such to have a density of between 20 and 100 protrusion per cm.

While specific embodiments of the invention have been shown and described in detail to illustrate the application of the principles of the invention, it will be understood that the invention may be embodied otherwise without departing from such principles.

What is claimed is:

1. A system for the production of tissue paper, comprising:

at least one headbox;

at least one formation fabric, on which said headbox distributes a layer of an aqueous suspension of papermaking fibers;

a system of removal of water from said layer to bring said layer to a first degree of dry content;

an embossing assembly comprising a first embossing roller and a second embossing roller, said first embossing roller and said second embossing roller forming a nip therebetween, said first embossing roller and said second embossing roller comprising protuberances and cavities, said protuberances of one of said first embossing roller and said second embossing roller penetrating into said cavities of another one of said first embossing roller and said second embossing roller, said layer being removed from said system of removal of water after reducing a water content of said layer to provide a layer free of support, said layer free of support passing between said first embossing roller and said second embossing roller prior to drying to form an embossed layer of papermaking fibers; and a system for drying the embossed layer of papermaking fibers, said system for drying being located downstream of said nip.

2. A system according to claim 1, wherein said protuberances are generated by incision, the cavities being defined by the empty spaces between adjacent protuberances.

3. A system according to claim 2, wherein at least one of said first embossing roller and said second embossing roller is provided with protuberances numbering between 20 and 100 per $cm^2$.

4. A system according to claim 3, wherein at least one of said first embossing roller and said second embossing roller is decorated via at least partial removal of said protuberances.

5. A system according to claim 2, wherein the protuberances of the first embossing roller and the second embossing have a base with a first dimension in a direction of advance of the layer and a second dimension in a transverse direction, said first dimension being smaller than said second dimension.

6. A system according to claim 1, wherein at least one of said first embossing roller and said second embossing roller is provided with protuberances numbering between 20 and 100 per $cm^2$.

7. A system according to claim 6, wherein at least one of said first embossing roller and said second embossing roller is decorated via at least partial removal of said protuberances.

8. A system according to claim 7, wherein at least one of said first embossing roller and said second embossing roller is decorated via at least partial removal of said protuberances.

9. A system according to claim 6, wherein at least one of said first embossing roller and said second embossing roller is decorated via at least partial removal of said protuberances.

10. A system according to claim 1, wherein at least one of said first embossing roller and said second embossing roller is decorated via at least partial removal of said protuberances.

11. A system according to claim 1, wherein the protuberances of the first embossing roller and said second embossing roller have a base with a first dimension in a direction of advance of the layer and a second dimension in a transverse direction, said first dimension being smaller than said second dimension.

12. A system according to claim 1, wherein said protuberances have a pyramidal shape with a quadrangular base.

13. A system according to claim 12, wherein said base is rhomboidal, with a minor diagonal oriented according to a direction of advance of the layer and major diagonal oriented according to a transverse direction.

14. A system according to claim 1, wherein said protuberances have a shape with rounded edges.

15. A system according to claim 1, wherein said first embossing roller and said second embossing roller are metal rollers.

16. A system according to claim 1, wherein said first embossing roller and said second embossing roller are set at a distance such that surfaces of the protuberances and of the cavities are not in mutual contact.

17. A system according to claim 16, wherein said first embossing roller and said second embossing roller are set at a distance between centers such that the surfaces of the protuberances and the surfaces of the cavities are at a distance from one another by an amount equal to or slightly greater than a thickness of the layer of papermaking fibers fed into said nip.

18. A system according to claim 1, wherein said layer is partially dried prior to embossing up to a value that will render said layer capable of supporting embossing of said layer.

19. A system according to claim 1, wherein said first value of the weight percentage of fibers in said layer is between 50 wt % and 90 wt %.

20. A system according to claim 1, wherein said layer is detached from the system of removal of water without the use of a creping blade.

21. A system according to claim 1, wherein at least one of the first embossing roller and the second embossing roller is heated.

22. A system according to claim 1, wherein one or more hot-air hoods are associated with the system for drying the embossed layer of papermaking fibers.

23. A system according to claim 1, wherein said drying system comprises a heated cylinder, around which said layer is entrained and from which said layer is detached at an end of a drying process.

24. A system according to claim 23, wherein there is not provided a creping blade associated with said heated cylinder.

25. A system according to claim 1, wherein said first embossing roller and said second embossing roller are provided with protrusions and the cavities have a linear shape extending substantially parallel to axes of said first embossing roller and said second embossing roller.

26. A system for the production of tissue paper, comprising:

a headbox;

a formation fabric, said headbox distributing a layer of an aqueous suspension of papermaking fibers, said layer of aqueous suspension of papermaking fibers forming a wet layer on said formation fabric;

a first drying system for receiving said wet layer and removing moisture from said wet layer to form a partially dried layer;

an embossing assembly comprising a first embossing roller and a second embossing roller, said first embossing roller and said second embossing roller defining an embossing nip therebetween, said first embossing roller and said second embossing roller comprising protuberances and cavities, said first embossing roller and said second embossing roller being arranged such that said protuberances of one of said first embossing roller and said second embossing roller penetrate into said cavities of another one of said first embossing roller and said second embossing roller in said embossing nip;

a layer advancing path extending through said embossing nip, whereby said partially dried layer advances along said advancing path through said nip without support and said partially dried layer is embossed by said first embossing roller and said second embossing roller to form an embossed partially dried layer; and a second drying system for receiving said embossed partially dried layer and for drying said embossed partially dried layer to form a substantially dried web of tissue paper.

* * * * *